US005333925A

United States Patent [19]

Foley, Jr.

[11] Patent Number: 5,333,925

[45] Date of Patent: Aug. 2, 1994

[54] CONTAINMENT APPARATUS FOR MANUAL PIPE TONGS

[76] Inventor: Larry Foley, Jr., P.O. Box 81007, Lafayette, La. 70508-4334

[21] Appl. No.: 11,513

[22] Filed: Feb. 1, 1993

[51] Int. Cl.[5] ..... E21B 19/16

[52] U.S. Cl. ..... 294/86.4; 294/102.2

[58] Field of Search ..... 294/1.1, 90, 91, 102.2, 294/106, 131, 86.4; 81/90.1, 90.3, 90.5, 90.7, 90.9

[56] References Cited

U.S. PATENT DOCUMENTS

| | | | |
|---|---|---|---|
| 1,501,962 | 7/1924 | Montgomery | 294/102.2 X |
| 3,675,278 | 7/1972 | Powell | 294/102.2 |
| 4,661,038 | 4/1987 | Kohler et al. | 294/86.4 X |
| 4,741,642 | 5/1988 | Carlton | 294/86.4 X |
| 4,822,200 | 4/1989 | Berner | 294/86.4 X |
| 5,020,844 | 6/1991 | Pickrell | 294/86.4 |

*Primary Examiner*—Dean J. Kramer
*Attorney, Agent, or Firm*—Robert Montgomery

[57] ABSTRACT

The present invention relates to a method and apparatus for containing and restraining the fragmentation of the jaw portion of a set of mechanical pipe tongs, under stress load conditions. The apparatus comprising a flexible belts or the like surrounding the jaws of the tongs like a girdle and attached to an energy absorber located at either side of the tongs' body.

10 Claims, 3 Drawing Sheets

CONTAINMENT APPARATUS FOR MANUAL PIPE TONGS

BACKGROUND OF THE INVENTION

1. Field of the Invention

The present invention relates to manual pipe tongs and, more particularly to an apparatus for restraining and suppressing the sudden fragmentation of such tongs.

2. General Background

Manual pipe tongs are used in conjunction with oil and gas well drilling and production operations for separating tubular joints. Manual pipe tongs often are required to exert forces in excess of 100,000 ft-lbs of torque. Such forces produce extremely high stresses on the working components of the tongs. In some cases, the workers use sledge hammers to shock the joint into release. Such abuse coupled with stored stress very often results in catastrophic failure of the tongs. When fragmentation of the tongs occurs, parts of the tongs can be propelled at high velocity in all directions, exposing workers to possible injury or death. In fact statistics have shown that 70 percent of all drilling rig accidents are caused by tongs.

SUMMARY OF THE PRESENT INVENTION

The present invention relates to a means for containing fragmentation of the tongs by restraining the critical portions of a set of mechanical pipe tongs under stress load conditions. Such containment comprising a pair of synthetic flexible web belts or the like surrounding the jaws of the tongs like a girdle. One end of each belt segment is fitted with a portion of a quick-release male-to female-coupling or simply attached immediately adjacent to the jaws. In the latter case the flexible members would be threaded through openings or eyelets on each part, such as the handles, or in such a manner as to positively connect all of the tongs' components subjected to high stress. The opposite end is attached to an energy-absorbing device such-as a spring or hydraulic energy obsorber, which is itself attached to the tongs' lever arm, located adjacent to the articulated jaws. Therefore, when the tongs are latched around the pipe joint and placed under stress and fragmentation occurs, the velocity of such dismembered components within the circumference of the girdle-like restraining belts will be absorbed due to the displacement of the flexible member acting on the energy absorbing device.

DETAILED DESCRIPTION OF THE PREFERRED EMBODIMENT

Figure 1:
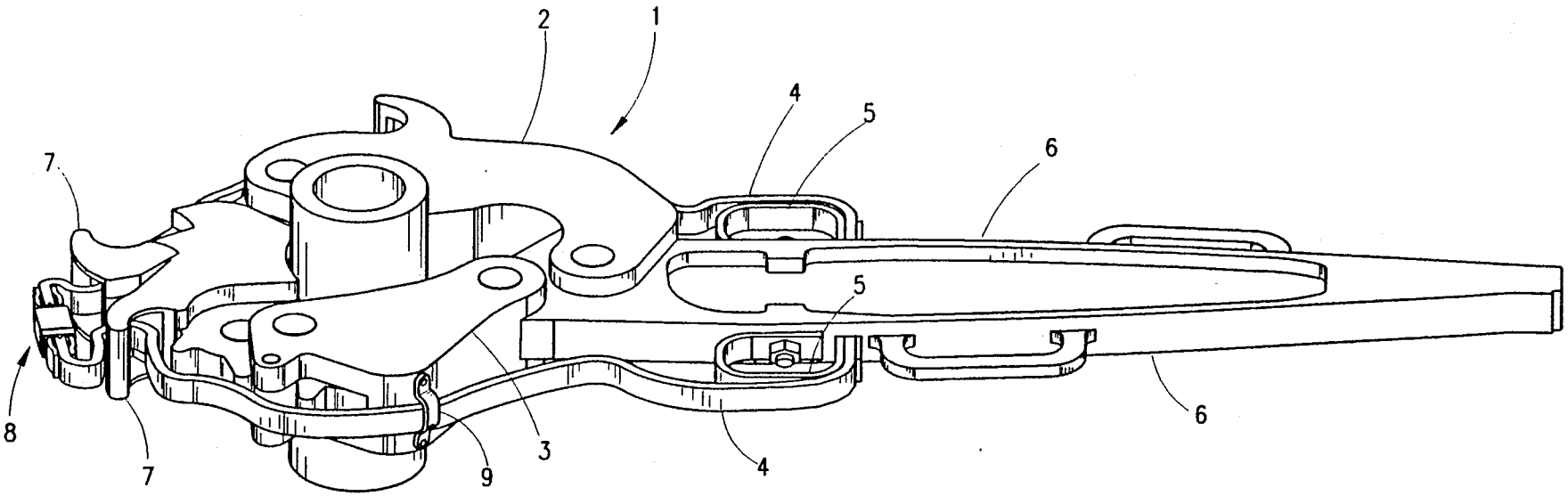
FIG. 1 is an isometric view of the present invention in a relaxed state, attached to a typical set of mechanical pipe tongs.

The preferred embodiment of the present invention as shown in FIG. 1 is best described as a flexible girdle encircling the jaws 2,3, of mechanical pipe tongs 1. A flexible member 4, such as a belt, cable, or the like, is shown restrained at one end by an energy absorbing means 5, which is in turn removable attached to either side of the tongs lever 6. The biasing means 5, serves as an energy-absorbing means. The opposite end of each of the flexible members 4 passes through the tong jaw handles 7 and is coupled by a quick release latching buckle 8. The latching consisting of a male and female segment. It is further anticipated that the flexible members 4 may be passed through additional eyelets 9 as may be required to further retain all critical components of the tong jaws 2 & 3.

Figure 2:
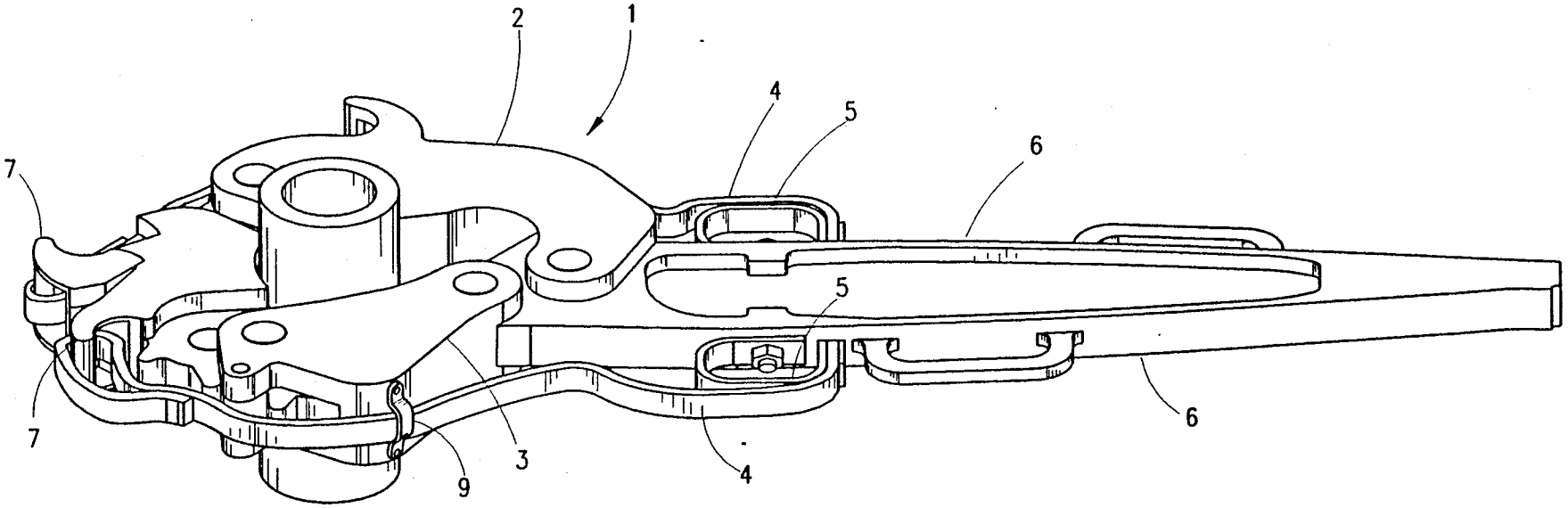
FIG. 2 is an isometric view of an alternative embodiment of the present invention showing the flexible members attached to the tongs' jaw handles.

It has been found that the flexible members 4 need not be coupled to each other by the quick-release latch means 8. The flexible member 4 can be simply looped around the jaw handles as shown in FIG. 2

Figure 3:
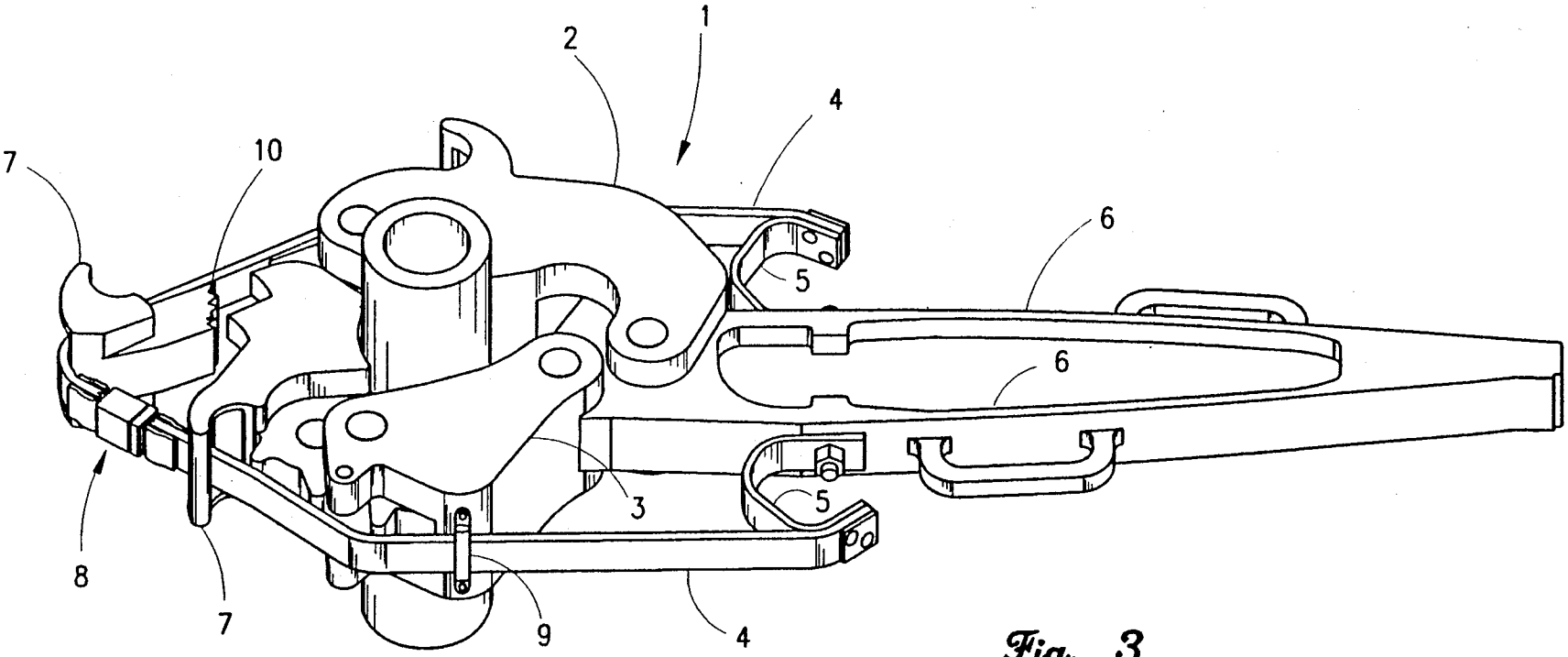
FIG. 3 is an isometric view of the present invention in the operative condition showing a fragmented portion of the tongs' jaw 10 being restrained by the flexible members 4.

Turning now to FIG. 3, we see how the flexible members 4 react on the energy absorbing means 5 when some portion of the tongs' jaws 2,3, fragment. A portion 10 of the tongs' right jaw 2 is shown separated from the jaw 2 and is restrained by the flexible members 4 acting on the energy absorbing means 5. It can be clearly seen that any large segment of the jaws 2,3 within the circumference of the flexible members 4 would be restrained and rendered harmless by the action of the energy absorbing means 5.

What is claimed is:

1. A girdle for pipe tongs comprising:

a) a mechanical pipe tong having a body and a pivotal arms;

b) at least one energy-absorbing means, attached to one side of said body;

c) a flexible member, encircling said tong arm attached at one end to said energy absorbing means with the opposite end attached to said tong body opposite said energy-absorbing means; and d) a quick-release latch means integral with said flexible member, for parting said flexible member.

2. A girdle for pipe tongs according to claim 1, wherein said flexible member has one of said energy-absorbing means attached at each end.

3. A girdle for pipe tongs according to claim 2, wherein said flexible member is a cable.

4. A girdle for pipe tongs according to claim 3, wherein said quick-release latch is a buckle having male-to-female coupling components.

5. A girdle for pipe tongs according to claim 4, wherein said flexible member is held in loose conformity, externally, around said tong arms by eyelets attached to said tong pivotal arms.

6. A mechanical pipe tong retainer for use in collectively containing dismembered components during fragmentation comprising:

a) a mechanical pipe gripping apparatus, for use in separating threaded tubulars, having a body portion and a pair of pivotal arms, selectively movable between a normally open position to a closed gripping position around a pipe joint;

b) a flexible member at least partially encircling the external perimeter of said pivotal arms when in the closed position;

c) a biasing means for connecting the ends of said flexible member to said body portion; and d) a coupling means integral with said flexible member for parting said flexible member during positioning of said gripping apparatus around said pipe joint.

7. A mechanical pipe tong retainer for use in collectively containing dismembered components during fragmentation according to claim 6 wherein said flexible member is a cable.

8. A mechanical pipe tong retainer for use in collectively containing dismembered components during fragmentation according to claim 7 wherein said coupling means is a quick release latching buckle.

9. A mechanical pipe tong retainer for use in collectively containing dismembered components during fragmentation according to claim 8 wherein said flexible member is further externally retained in loose conformity to said pivotal arms by eyelets attached at critical stress points.

10. A mechanical pipe tong retainer for use in collectively containing dismembered components during fragmentation according to claim 6 wherein said flexible member is a web belt.

* * * * *